United States Patent [19]

Emonet

[11] 4,327,807

[45] May 4, 1982

[54] PERCUSSION TOOL CASING

[75] Inventor: Henri Emonet, Montbrison-Loire, France

[73] Assignee: Maco-Meudon, France

[21] Appl. No.: 943,723

[22] Filed: Sep. 19, 1978

[51] Int. Cl.[3] ..... B25D 9/04

[52] U.S. Cl. ..... 173/134; 173/DIG. 2; 173/139; 173/162 R; 92/128

[58] Field of Search ..... 173/134, 135, 138, 114, 173/116, 90, 139, DIG. 2, 162 R, 162 H, 118, 29; 92/128; 29/156.7 R

[56] References Cited

U.S. PATENT DOCUMENTS

| | | | |
|---|---|---|---|
| 1,463,595 | 7/1923 | Saunders | 173/162 H |
| 1,578,434 | 3/1926 | Hansen | 173/162 H |
| 1,679,291 | 7/1928 | Byers | 173/134 |
| 1,703,229 | 2/1929 | Gartin | 173/134 X |
| 2,703,557 | 3/1955 | Polki | 92/128 X |
| 3,002,866 | 10/1961 | Gartnell . | |
| 3,065,734 | 11/1962 | Molzahn | 92/128 |
| 3,100,676 | 8/1963 | Christie . | |
| 3,223,181 | 12/1965 | Price | 173/134 X |
| 3,554,088 | 1/1971 | Bruyn | 92/128 |
| 3,660,943 | 5/1972 | Barnthouse . | |
| 3,661,216 | 5/1972 | Yamanaka | 92/128 X |
| 3,662,855 | 5/1972 | Adams | 173/139 X |
| 3,875,275 | 4/1975 | Lemelson . | |
| 3,920,086 | 11/1975 | Goppen et al. . | |
| 4,044,625 | 8/1977 | D'Haem et al. | 173/162 R |
| 4,067,400 | 1/1978 | Nikolaev et al. | 173/134 |
| 4,081,038 | 3/1978 | Andersson et al. | 173/162 R |
| 4,189,517 | 2/1980 | Shanoski et al. . | |

FOREIGN PATENT DOCUMENTS

| | | | |
|---|---|---|---|
| 1213813 | 4/1966 | Fed. Rep. of Germany | 173/134 |
| 806543 | 12/1936 | France | 173/135 |
| 55630 | 5/1967 | German Democratic Rep. | 173/90 |
| 849246 | 9/1960 | United Kingdom . | |
| 1424217 | 2/1976 | United Kingdom | 173/162 R |

*Primary Examiner*—Werner H. Schroeder
*Assistant Examiner*—Andrew M. Falik
*Attorney, Agent, or Firm*—Remy J. VanOphem

[57] ABSTRACT

A reciprocating piston jack-hammer is provided with an easily detachable air distribution mechanism, a resilient casing for muffling the noise by the emitted air, and a shock absorbing housing. A cylindrical tube houses the reciprocating piston and has molded thereabout a housing with air channels between the housing and the tube. The handle of the jack-hammer has a cavity and a mechanism which controls the supply of compressed air to the distribution system. The distribution system employs two parts, one disposed in the other, with an oscillating pellet between the two parts, which oscillating pellet serves to distribute the incoming compressed air either to drive the piston or to direct the air to a piston relief channel, thereby returning the piston to the upper position. Upon return of the piston to its upper position, the air is exhausted from the cylinder below the piston out to a muffling exhaust chamber, out to the atmosphere. The cavity communicates with the tube so as to permit the accessibility of the air distributor unit through the handle.

15 Claims, 20 Drawing Figures

Fig-12
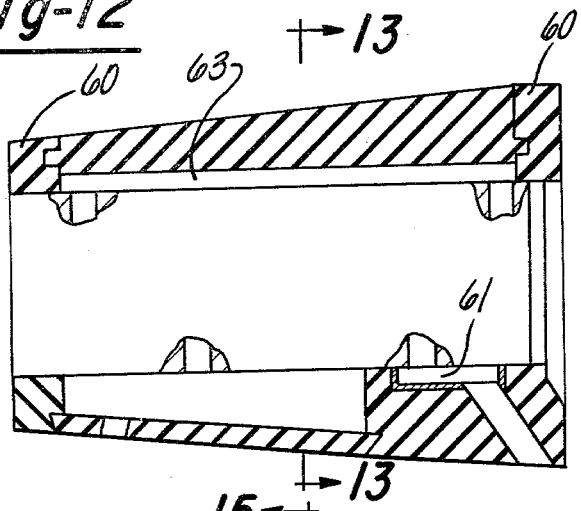
Fig-13
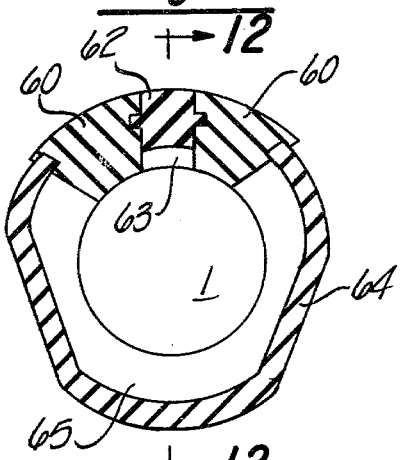
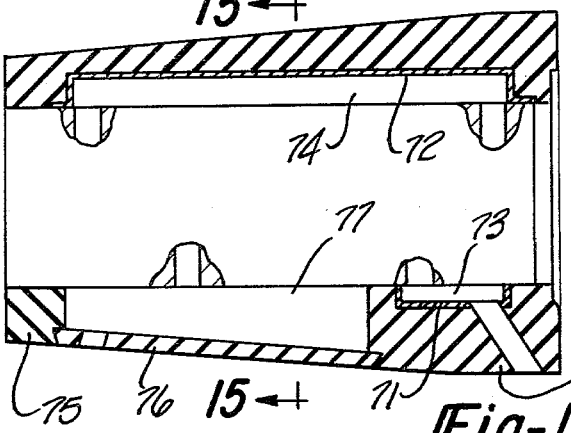
Fig-14
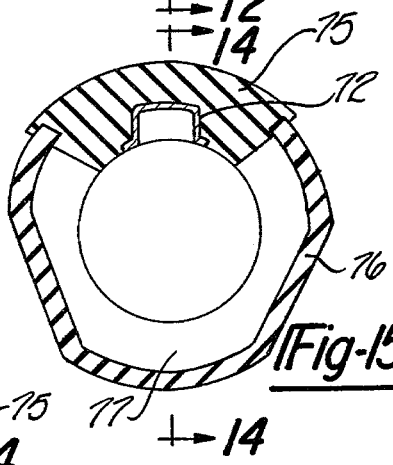
Fig-15
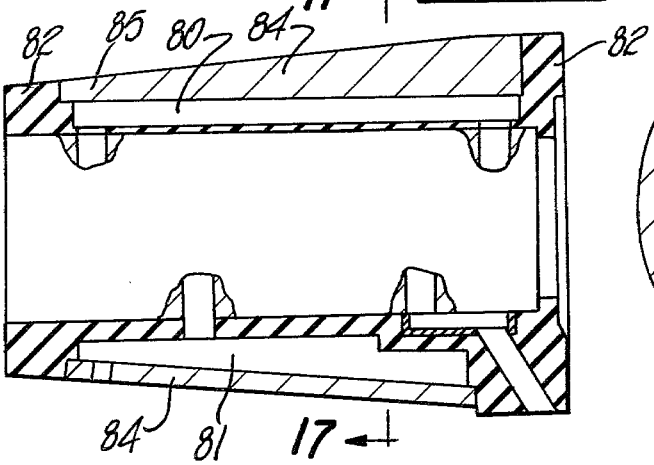
Fig-16
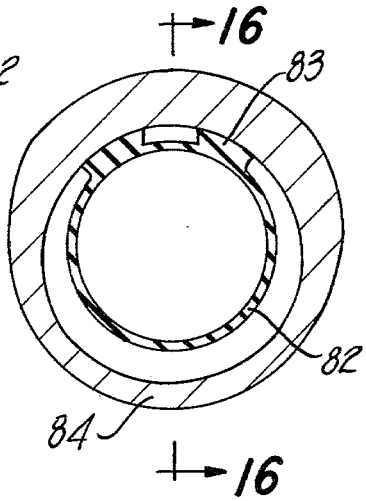
Fig-17

PERCUSSION TOOL CASING

BACKGROUND OF THE INVENTION

1. Field of the Invention

The present invention concerns a jack-hammer, and particularly its structure and the assembly of the various parts thereof.

2. Description of the Prior Art

Basically, a jack-hammer includes a cylindrical body housing having a reciprocating piston therein which is reciprocally moved by the action of compressed air distributed by an oscillating pellet.

Usually, this cylindrical body is made of forged steel and machined so as to obtain:

- a guiding hole for guiding the tool or working pick;
- a seat located inside the cylinder to limit the forward stroke of the piston;
- compressed air distributing channels, one of them leading to the front of the cylinder and the other to the rear of the said cylinder; and
- a housing for the compressed air distribution unit, controlled, for example, by a check valve which is itself controlled by a lever pivotally mounted on the jack-hammer handle.

One of the disadvantages of the above systems is that the machining of such a cylindrical body housing is often complex and this can cause the cost of the jack-hammer to be high.

Furthermore, the access to the various components in the cylindrical body housing is accomplished with difficulty which complicates the maintenance of the jack-hammer in corroding conditions (such as for example, public work sites, mines and the like).

Finally, the cost of the jack-hammer is also increased when equipped with a muffler or noise abatement system as well as with a handle shock absorbing system.

The purpose of this invention is to overcome these disadvantages, and to build a light and economical jack-hammer, and still improve its reliability and efficiency, and greatly facilitate its maintenance. All of these results are achieved by the present invention which provides a new structure adapted to a silent jack-hammer and which provides a shock absorber equiped handle.

SUMMARY OF THE INVENTION

A jack-hammer modified according to this invention is of a type similar to those which are controlled by the reciprocating movement of a piston moving inside a cylinder through the action of a compressed air distributor and is characterized by:

- a cylindrical tube which is the body of the device;
- a counterbored sleeve, including a central, axial hole; this counterbored sleeve is at least partially fitted lengthwise inside the tube at one end along the axis of the cylindrical tube;
- a distributor unit comprising two parts mounted on the opposite end of the tube and closes off the rear end of the tube;
- detachable mounts to assemble and lock together the tube, the two distributor parts, a catch or pin and a moulded part fitted around the tube to channel the compressed air flow system;
- a casing made of a shock absorbing material and protecting most of the operating areas of the tube, but constructed of a material which is strong enough to form the handle of the machine; and

- a piston moving between a stop piece formed by the rear end of the guiding sleeve of the pick or tool and the front wall of a part of the detachable air distribution system.

According to another characteristic, the compressed air distributor system is obtained through casting or molding of a material such as aluminum or aluminum alloy, or even a synthetic material such as rigid elastomer or rubber. This casting is made on a cylindrical die equipped with at least two side inserts to provide:

- a relief channel connecting the distributor to the front part of the cylinder by the first insert of the die; and
- an air muffler and exhaust chamber communicating with holes provided on the side wall of the cylinder tube by the second insert of the die.

According to another characteristic, the cast part forming the compressed distributor system includes at one end, a recess located in an internal wall which forms the inlet chamber for the compressed air coming from an air distributor feeder.

According to another characteristic, the distributor block is fastened inside the tube by a cotter pin introduced in holes in the tube walls of each distributor part, the casting and the shock absorbing casing. This cotter pin is locked by the resilient casing itself.

According to another characteristic, the casing provides above the cylindrical tube, a hollow handle equipped with a lever which is pivotally connected at one end of the handle. The other end of the lever acts against the back end of a sliding rod contained in the handle. The sliding rod controls, through its front end, a truncated cone block or similar piece, which is equipped with a spring mechanism and held in such a position that it shuts off the distributor chamber air inlet. Thus, when the sliding rod is pushed, it pushes the block against the spring mechanism so as to tilt it and force its base away from the inlet hole. The air is thus fed into the distributor unit and which causes the oscillating pellet in the distributor unit to vibrate.

According to another characteristic, the counterbored sleeve is press fitted to the inside of the front end of the tube, with the distributor block being locked thereto by a simple cotter pin. Thus, by pulling the pin, it is possible to disassemble, from the back of the jack-hammer, that is, near the handle, all of the moving components including the distributor and the piston.

This construction is clearly aimed at limiting to simple, quick and inexpensive operations, the machining of metal or even rubber parts (such as drilling or boring of simple elements). Moreover, the die used for the construction of the compressed air system is a simple mechanical mold producing a part which does not require any further boring on the outside diameter of the tube.

It is thus possible to obtain an economical jack-hammer, wherein maintenance is made easier by the accessibility of the distributor components through the cavity in the handle, without altering the design of the tool. Finally, the jack-hammer thus obtained is equipped with an exhaust muffler and a handle shock absorbing system.

Among its main advantages, and besides the simplified machining and molding procedures, the following features should be noted:

- lightness of the device which can operate in any position;
- reliability and easy replacement of the distributor, compressed air feeding control unit (the normal check valve being replaced by a swiveling block); and safety lock of the air through the casing, the elasticity of which allows for the quick removal of the cotter pin.

BRIEF DESCRIPTION OF THE DRAWINGS

The attached drawings, given as a non-exclusive example, permits a better understanding of the invention.

FIGS. 12 and 13 represent another version in which the exhaust muffler chamber is encapsulated by a moulding of noise insulating material which is fastened to the shock absorbing casing of a second alternate embodiment.

FIGS. 14 and 15 show a longitudinal cross sectional view and a cross sectional view along line 15—15 of FIG. 14 of a third alternate embodiment of the invention.

FIGS. 16 and 17 show a sectional view and longitudinal cross section view of a fourth alternate embodiment of the invention in which the air channel walls are noise insulated.

DESCRIPTION OF THE PREFERRED EMBODIMENT

Figure 8:
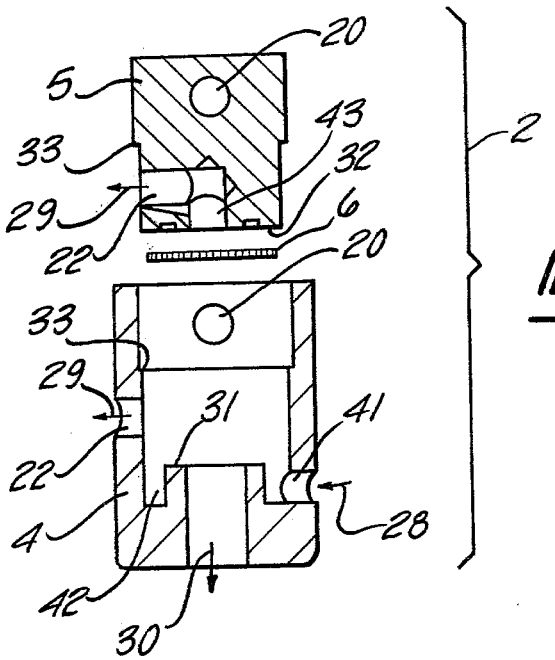
FIG. 8 shows the detail of the structure of the distributor block.

The drawings illustrate a percussion device of the hand jack-hammer type 11. This device includes:

a body consisting of a tube 1;

a compressed air distribution unit 2 with an inlet port 3; the distribution unit 2 includes two parts 4 and 5 between which a pellet 6 oscillates as best shown in FIG. 8. The distribution unit 2 is located inside and at the rear part or rightward portion of the tube 1 as viewed in FIG. 1;

a sleeve press is fitted on the front part of the tube which sleeve 7 includes a hexagonal bore 8 which constitutes the axial guide for a pick or tool (not shown);

a piston 9 reciprocates between the rear end of the sleeve and the front cross-wall of the distributor, the piston 9 moving within the cylinder 10 defined by the side wall of the tube 1;

a hollow handle 12 is made in one piece from a casing 13 which is cast to the side walls of the device;

a compressed air inlet control lever 14;

a cotter pin 15 which locks the distribution unit 2 to the rear part of the tube 1; and at least one cast part 16 on the outside of the rear part of the tube 1, the part 16 constituting for example, the cavity forming the air inlet chamber 17, the relief channel 18 connecting the front of the cylinder to the distribution unit 2 and finally, an exhaust chamber 19 allowing for a silent operation of the device 11.

Figure 1:
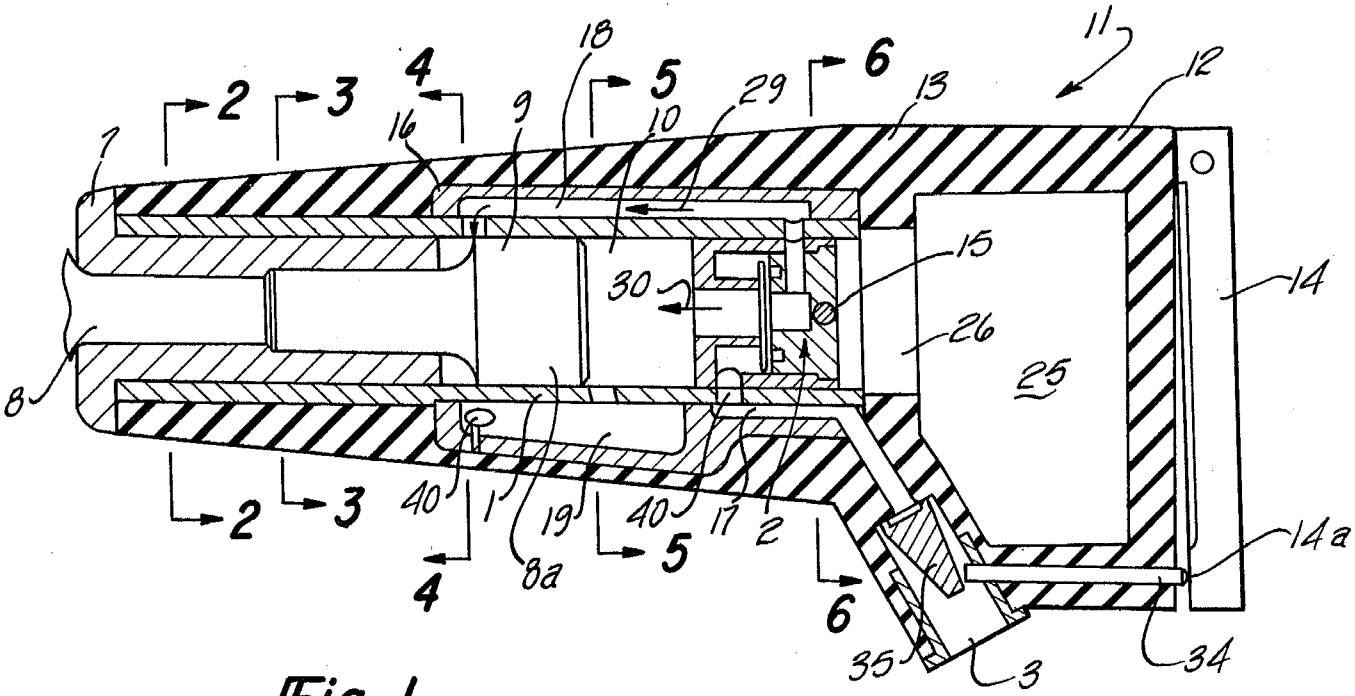
FIG. 1 shows a longitudinal cross sectional view of a jack-hammer according to the invention.

The assembled device 11 is shown in FIG. 1. FIGS. 2 through 6 however, respectively illustrate various cross sectional views of the device 11, along lines 2—2 through 6—6, perpendicular to the longitudinal axis of the device 11. These sections show, as discussed below, the simple construction and assembly of the device.

Figures 2, 3, 4, 5, 6:
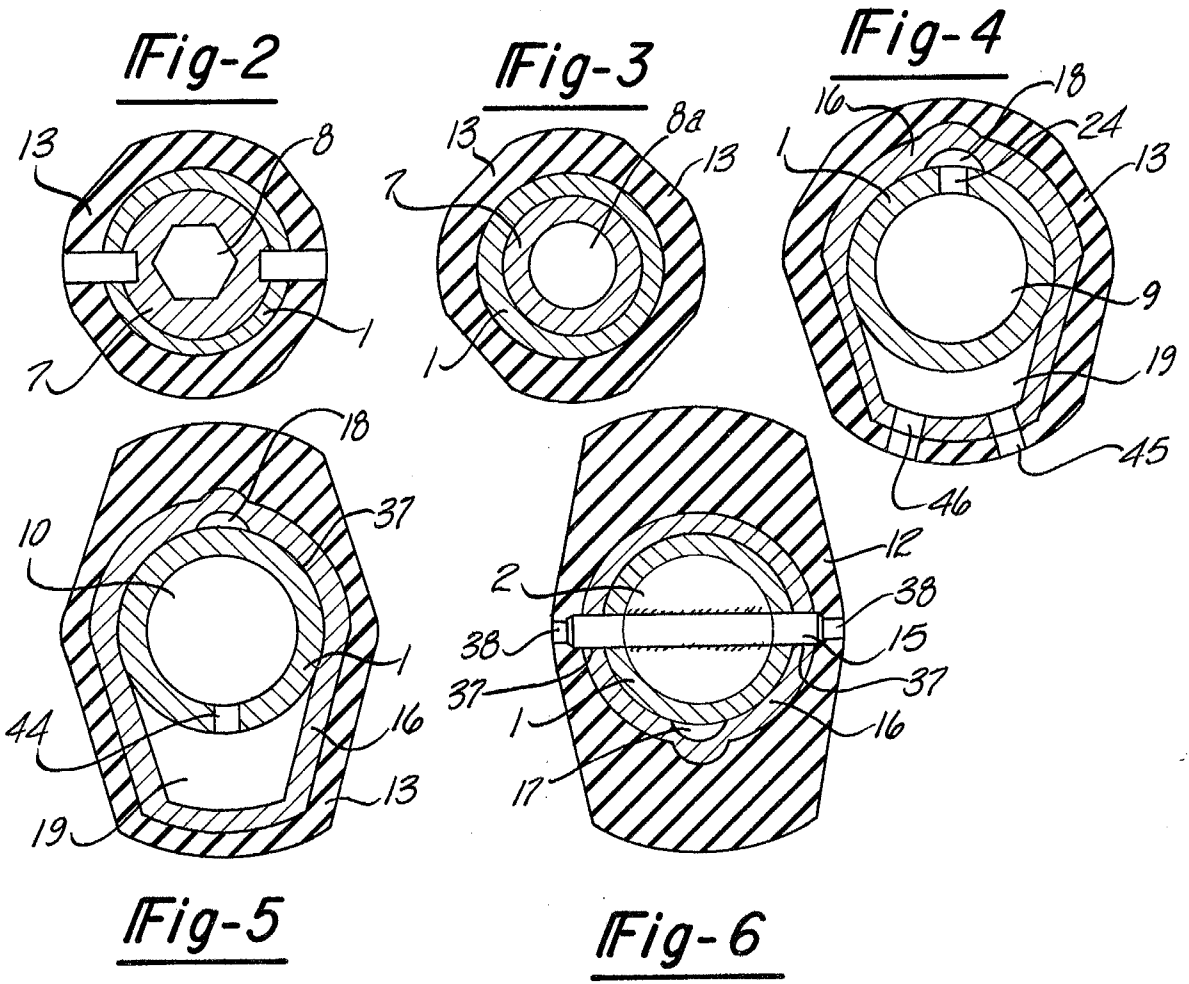
FIGS. 2 through 6 show sectional views taken along lines 2—2, 3—3, 4—4, 5—5 and 6—6 respectively of FIG. 1.
Figure 7:
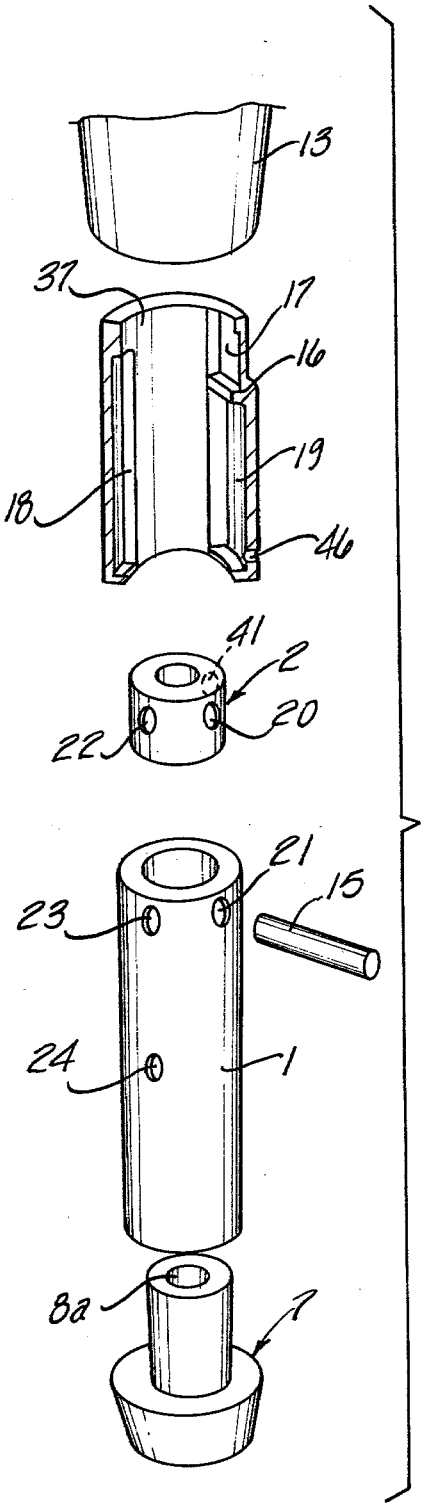
FIG. 7 is an exploded view of the main components of the device.

The basic components of the device 11 are shown in the exploded view of FIG. 7. The distributor unit 2, as well as the tube 1 and the cast part 16, have their side walls drilled with holes 20, 21 and 37, respectively for the installation of the lock-pin or cotter pin 15 therethrough. Other holes such as 22, 23 and 24 provide the compressed air supply holes. The sleeve 7 has a counterbore and is machined so that its cylindrical rear portion 8*a* can be press-fitted in the front end of the tube 1. As stated previously, the rear part of the tube 1 receives the distribution unit 2. The part 16 is cast on a cylindrical die similar in shape to the tube 1, and is equipped with side metal inserts used to form the cavities 17, 18 and 19 in a pattern well known in the art. After the items 1, 2, 7 and 16 have been positioned and locked with one another (they are then aligned as shown in FIGS. 1 through 6), the casing 13 has a rear portion which is drilled through from side to side to form a cavity 25 as best shown in FIGS. 1 and 2 to thus form a shock absorbing handle 12. The cavity 25 communicates with the inside of tube 1 through a hole 26 drilled in the casing 12.

FIG. 8 shows the structure of the distribution unit 2, including:

two parts 4 and 5 assembled one inside the other;

one oscillating pellet 6; and holes are provided to lock the two parts together, on the one hand, and the holes also distribute the air into the inlet 28, then to the relief channel 29, and to the percussion channel 30.

The stroke of the pellet 6 is defined by the respective positions of the seats 31 and 32 when the parts are locked together against the counterbore 33.

Figure 9:
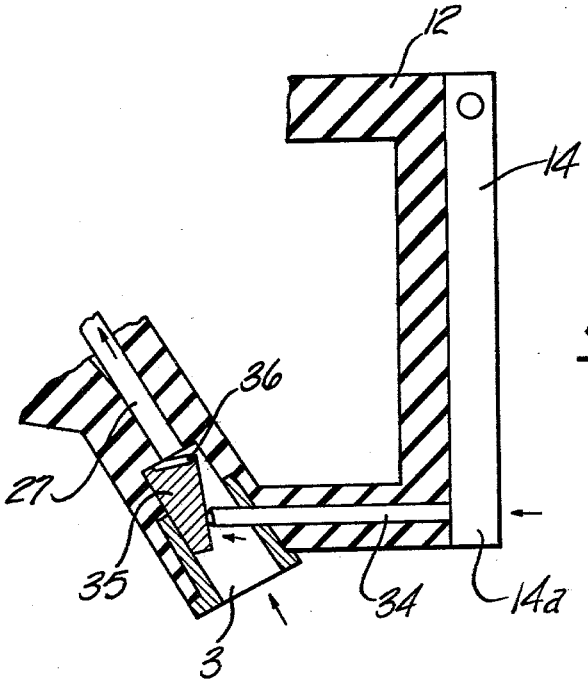
FIG. 9 is a partial detailed sectional view of the compressed air inlet control system.

The inlet air control to the device 11 is illustrated in FIGS. 1 and 9. The lever 14 is pivotally connected to the handle. The lever 14 controls, through its free end 14*a*, the movement of the sliding rod 34. One end of the rod 34 pushes against the side face of a truncated cone block 35. The base of the cone block 35 shuts off the air inlet (the deactivated position is shown in FIG. 1). When the lever 14 is pushed, the rod 34 pushes against the block 35 and causes the block to swivel so that the opposite face comes in contact against the wall of the port 3. The peripheral sealing flange of the large base 36 moves away from the inlet hole (FIG. 9) which induces the feeding of compressed air to the inlet chamber 17 and then to the distributor unit 2.

Figure 20:
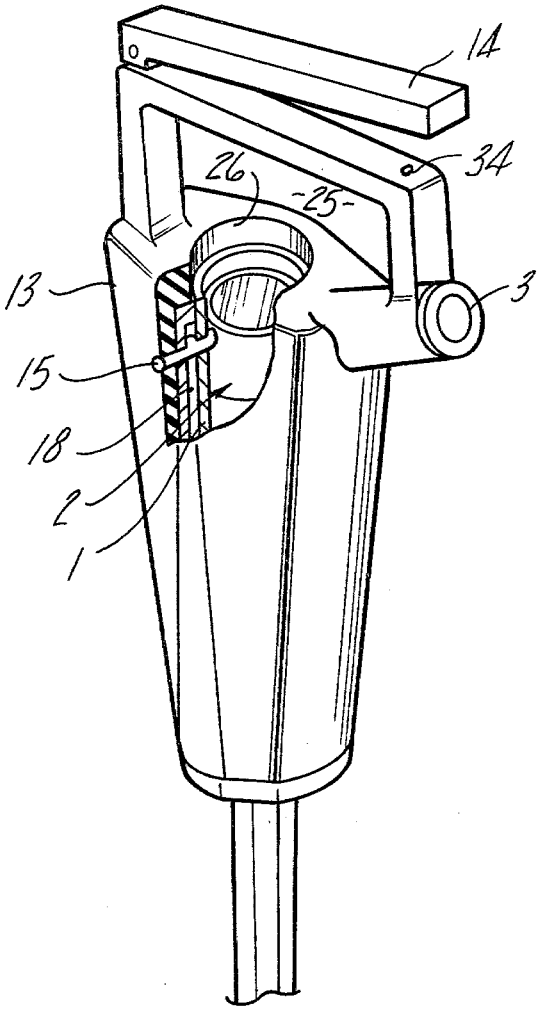
FIG. 20 shows a perspective view of the handle and the opening providing access to the air distributor unit through the cavity in the handle.
Figure 1:
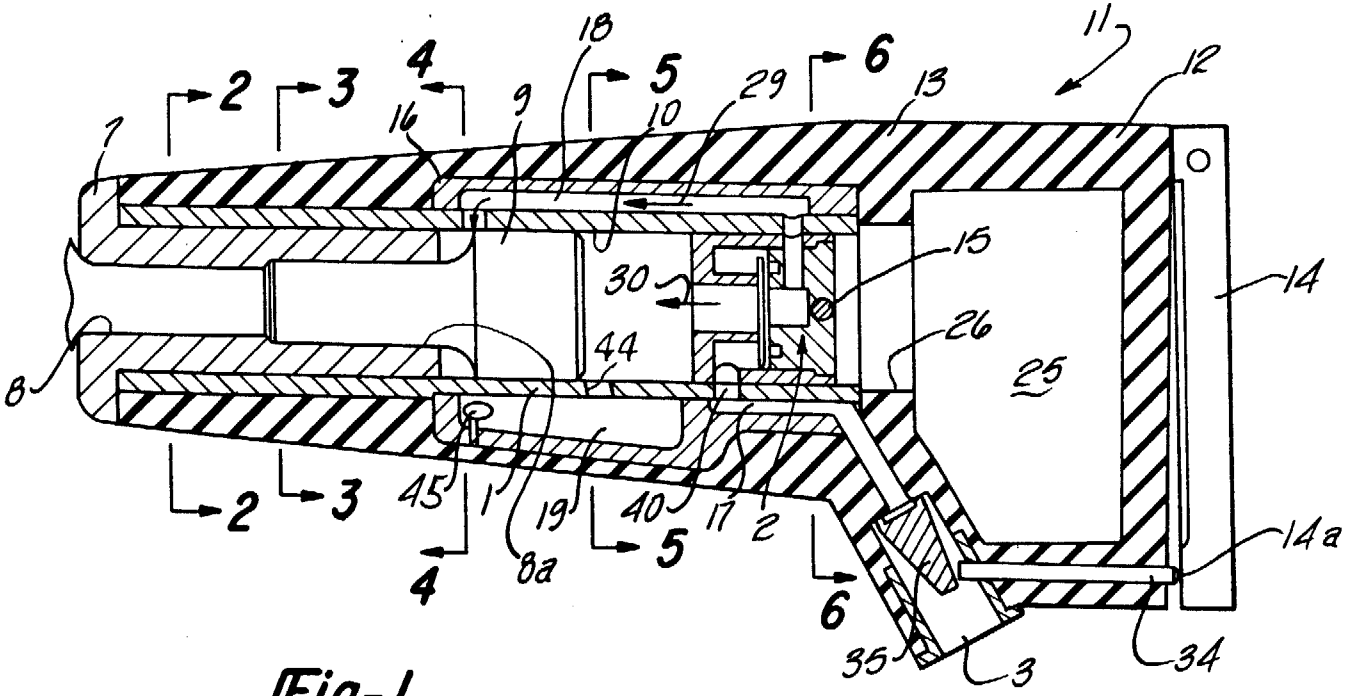
Figure 7:
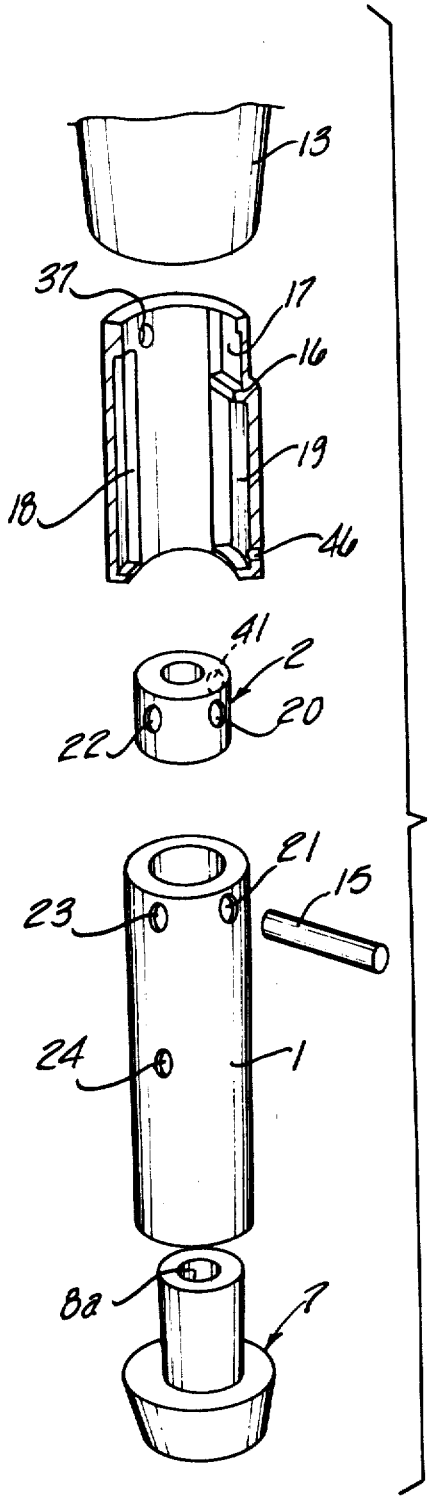

The assembly of the jack-hammer is accomplished following these steps and referring to FIGS. 1 through 8:

inserting the piston 9 in the tube 1;

press-fitting the sleeve 7 into the tube 1, the sleeve having an axial bore which defines a small diameter for guiding the power from the piston 9 to the pick or tool;

assembling the two parts of the distributor unit 2 together which is then mounted on the rear end of the tube 1;

positioning the cotter-pin 15 into the holes 20 and 21 which locks the parts 4 and 5 in the tube 1. The external machined portion of the cotter-pin 15 is received in the bored, centered hole 37 in the cast part 16;

casting in situ, the resilient material casing 13 to the side walls of the device. The casing 13 therefore covers most of the metal elements and provides, in the rear, a hollow portion 12 which forms the handle and allows for the disassembly and maintenance (or replacement) of the working components, particularly the distributor unit 2 and the piston 9 as shown in FIGS. 1 and 20; and drilling holes 38 in the casing 13. The casing 13 is made of 85 shores hardness rubber, or similar elastomer. The holes 38 are in alignment with the pin 15 positioning holes. The holes 38 have a slightly smaller diameter than that of the cotter-pin 15 so that the pin is axially locked but the elasticity of the rubber allows for the removal of the pin to permit the disassembly of the unit.

The device is now ready to operate, the compressed air distribution sequence being defined as follows and referring to FIGS. 1 and 4 through 9:

(a) percussion stroke: the air enters past the block 35, through hole 27 (FIG. 9), into the inlet chamber 17, and circulates through the radial holes 40 in the tube 1, hole 41 the in the distributor and into an annular pressure chamber 42 (FIG. 8). The pellet 6 is pushed against the rear seat 32 of the distributor, and the compressed air flows as shown by arrow 30 against the back of the piston.

(b) relief stroke: the pellet 6 oscillates and the chamber 42 communicates with the holes 22 in the distributor and holes 23 and 24 in the tube and with the relief channel 18. In this position, the pellet 6 rests against its seat 31 and the compressed air is sent to the front of the cylinder 10, following the arrow 29.

(c) exhaust: the air let into the cylinder 10 is exhausted as quickly as possible. For this purpose, the exhaust holes 44 are drilled in the tube 1 to let the cylinder 10 communicate with the exhaust chamber and the muffler 19. The air circulates in this chamber so as to regulate the air flow and thus eliminates the pressure "peaks" resulting from the alternating movement of the piston 9. Finally, vents 45, 46 are provided in the casing 13 and in the casting 16 respectively (which is press-fitted around the cylinder tube) to let the air exhaust outside.

From the foregoing, it is apparent that the compressed air jack-hammer is simple in construction. One of the main advantages of the present invention is to combine the "percussion" function, the shock absorbing function of the handle and the "muffling" function in an economical construction. Actually, the machining operations are simple and easy (for example, boring, lathing or drilling).

The base part consists of a tube on which it is possible to adapt a part which is molded or cast in a mold and whose cost is lower than the one required for prior art devices of the same type.

Finally, the disassembly (therefore the maintenance) of the unit is easy. The only operation required is to unlock the distribution unit 2 (by removing the pin 15 which is then forced between the holes 38 of the casing 13), and push on the piston 9 to retrieve, at the back of the device, all of the working parts which are recovered through the cavity 25.

The present invention permits modifications of a few details in the design, say for example, to obtain additional capacity for the cylinder lubricant. Furthermore, the illustrations given as examples in FIGS. 10 through 19 show, in particular, several arrangements (which are not exhaustive) of the compressed air circulating cavities.

Figure 11:
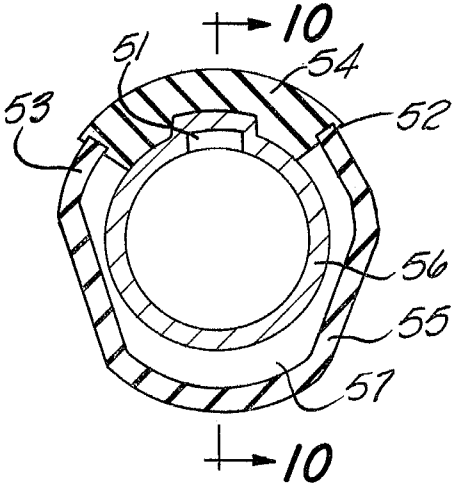
FIGS. 10 and 11 are, respectively, a longitudinal cross sectional view and a cross sectional view taken along line 11—11 of FIG. 10 in which the air channels are obtained by casting of parts made of aluminum or similar material about the tube and covering the cast part by a noise-insulating casing as a first alternate embodiment of the invention.
Figure 10:
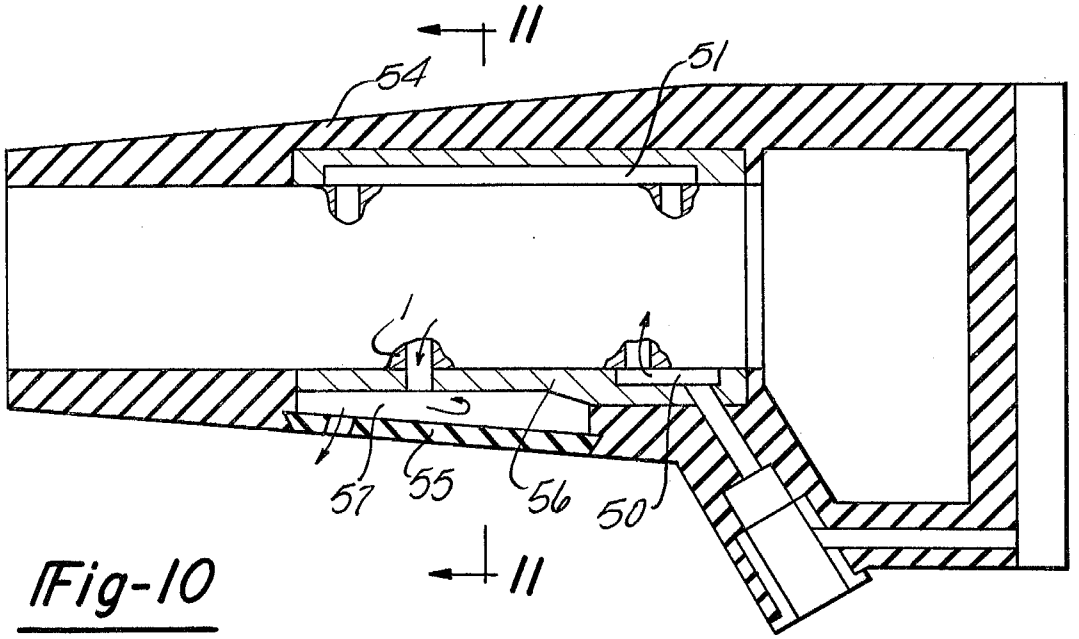

According to the construction described in FIGS. 1 through 7, the casting 16 defines, through its fitting on tube 1, the inlet chamber 17, the relief channel 18 and the exhaust chamber 19. FIGS. 10 and 11 show a simpler construction as a first alternate embodiment. This part 56 can be made from an aluminum alloy casting defining the side inlet chamber 50 and the relief channel 51. After molding of a rubber casing 13, a portion of the part 56 remains exposed. On the edges and at 53 of the casing 54, assembly or fastening elements are provided for the installation of a piece 55 made of a noise insulating material such as an elastomer or a rubber. An exhaust chamber 57 is thus formed whose dimensions are limited inside by the external wall of the casting 56 and outside by the internal face of the fastened piece 55. This chamber communicates, through various holes drilled in its walls, both with the cylinder and the outside of the device, the casing 54 being, as previously described, both noise insulating and shock absorbing.

In the second alternate embodiment illustrated by FIGS. 12 and 13, the casing is actually made of at least three pieces, which are fastened together, namely:

the casing 60 is molding on tube 1 after positioning of inserts to provide the inlet 61 and spaces which are open to inlet and exhaust holes for the air circulating inside the cylinder;

a casting 62 which is fastened by its sides on the casing 60 to form a relief channel 63 between its internal wall and the external wall of tube 1; and another casting 64, fastened in the same fashion as the previous one and designed to form the exhaust chamber 65.

According to the third alternate embodiment illustrated by FIGS. 14 and 15, the tube is equipped with two hollow inserts 71 and 72 to form the chamber 73 and the channel 73 upon moulding of the casing 75. A part rigidly mounted with each of the external shells of the mould provides a space around the tube. This space is then sealed by a piece 76 to form the chamber 77.

According to FIGS. 16 and 17, showing a fourth alternate embodiment, it is possible to line the internal and external walls of the channel 80 and of the exhaust chamber 81 with a noise insulating and shock absorbing material, directly moulded in one piece with the casing and the handle 82. The moulding is then covered by a sleeve 84 which is pressfitted on the embossments 83 and radially positioned by such brackets as 85. The sleeve 84 can be made of aluminum, elastomer or rubber material.

It should be noted that in the alternate embodiments presented in FIGS. 12 through 17, the only machining operations required are the drilling of the tube, and/or the inserts and/or the moulded materials whose edges offer appropriate shapes for the clipping or fastening of detachable castings.

Figure 19:
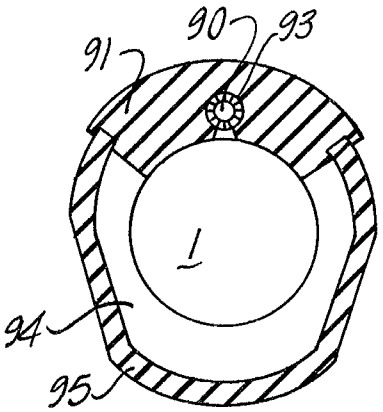
FIGS. 18 and 19 illustrate a longitudinal cross sectional view and a sectional view along line 19—19 of FIG. 18 which shows a fifth alternate embodiment which includes a secondary tube within the shock absorbing casing.
Figure 18:
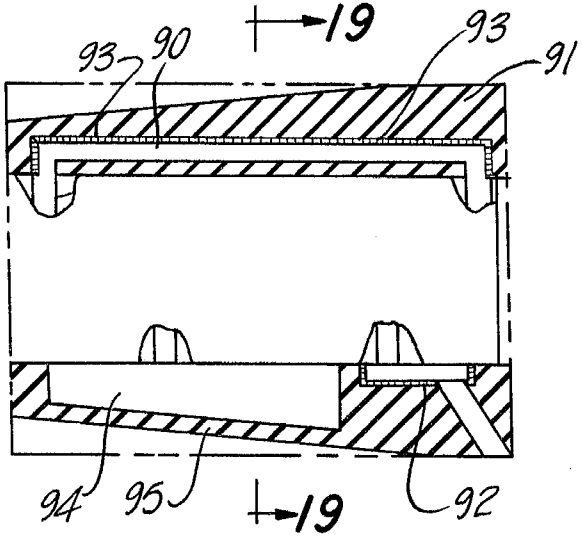

In a fifth alternate embodiment shown in FIGS. 18 and 19, the device's construction is very similar to the one illustrated on FIGS. 14 and 15. The only difference is that the relief channel 90 is insulated by moulding the casing 91 on a tube equipped, besides the side insert 92, with a tubular element 93 which includes elbows on each end and positioned so as to be roughly parallel to the axis of the tube 1. After moulding, the secondary tube 93 is covered by the casing 91, and its end elbows, which are roughly radial, communicate with the holes drilled in the distributor on the one hand, and in the front part of the cylinder on the other hand. The exhaust chamber 94 is enclosed by a prefilled piece 95 which is fastened onto the casing.

Having described my invention, it will become apparent to those skilled in the art it is possible to vary the distribution means, the shock absorbing material, the structure of the air passageways, the air inlet mechanism, and other portions of the invention without departing from the scope or spirit of the invention as defined in the following claims.

What I claim is:

1. A compressed air operated jack-hammer comprising:

a tube having an upper cylinder portion and a lower portion;

an air driven piston slidably disposed within said upper cylinder portion to transmit power to a tool;

a sleeve member fitted within said lower portion, said sleeve having a bore for receiving a tool;

a casting secured about said tube, said casting creating air passage means positioned between said cylinder portion and said casting;

a noise insulating, resilient casing enclosing said tube and said casting, said casing having a solid handle portion, said handle portion having a passage, said passage providing unobstructed access therethrough in a direction transverse to the plane of said solid handle portion; said casing adjacent the handle portion further having an opening which directly communicates both with said passage in the handle and said air distributing means; said handle portion further having means for controlling the supply of compressed air to the jack-hammer; and means for distributing compressed air supplied to the jack-hammer, said distributing means being releasably mounted in said tube, said distributing means cooperating with said means for controlling the supply of compressed air and with said air passage means between said cylinder portion and said casting, so as to provide compressed air to said cylinder, thereby causing said piston to reciprocate and drive a tool disposed within the jack-hammer, said distributing means further being accessible through said passage in said handle portion of said casing.

2. A jack-hammer according to claim 1 wherein said air passage means comprises a piston relief channel communicating with said cylinder below said piston, an exhaust chamber communicating both with said cylinder and with the atmosphere, and air inlet means communicating with the supply of compressed air.

3. A jack-hammer according to claim 1 wherein said casting is formed from aluminum or aluminum alloy.

4. A jack-hammer according to claim 1 wherein said sleeve is pressfitted into said tube.

5. A jack-hammer according to claim 1 wherein said casing is molded about said tube, thereby forming said air passage means.

6. A compressed air operated jack-hammer comprising:

a tube having an upper cylinder portion and a lower portion;

a air driven piston slidably disposed within said upper portion to transmit power to a tool;

a sleeve member fitted within said lower portion, said sleeve having a bore for receiving a tool;

a casting secured about said tube, said casting creating air passage means positioned between said cylinder portion and said casting;

a noise insulating resilient casing enclosing said tube and said casting, said casing having a solid handle portion, said handle portion having a passage, said passage providing unobstructed access therethrough in a direction transverse to the plane of said solid handle portion; said casing adjacent the handle portion further having an opening which directly communicates both with said passage in the handle and said air distributing means; said handle portion further having means for controlling the supply of compressed air to the jack-hammer and a portion defining an opening communicating with said upper cylinder portion of said tube; and means for distributing compressed air supplied to the jack-hammer, said distributing means being mounted in said tube, said distributing means cooperating with said means for controlling the supply of compressed air and with said air passage means between said cylinder portion and said casting, so as to provide compressed air to said cylinder, thereby causing said piston to reciprocate and drive a tool disposed within the jack-hammer, said air passage means further comprises a piston relief channel communicating with said cylinder below said piston, an exhaust chamber communicating both with said cylinder and with the atmosphere, and air inlet means communicating with the supply of compressed air, said distributing means further disposed in said tube so as to close said tube above said cylinder portion, said distributing means further being accessible through said passage in said handle portion of said casing and wherein said distributing means comprises:

an outside part having an air inlet hole communicating with said air inlet means, an air outlet hole communicating with said piston relief channel, and a bore communicating with said cylinder portion;

an inside part disposed within said outside part, said inside part having an air flow route communicating with said air outlet hole of said outside part; and an oscillating pellet oscillating between a first and second position, said pellet being disposed between said outside part and said inside part, such that at said first position of oscillation said pellet is sealed against said inside part air flow route and compressed air is thereby distributed from said air inlet chamber through said bore in said outside part to said cylinder portion above said piston, thereby driving said piston towards said lower portion so as to strike a tool disposed in the jack-hammer, and at said second position of oscillation, said pellet is sealed against said outside part bore and compressed air is thereby distributed from said air inlet means to said air flow route to said air outlet hole to said piston relief channel to said cylinder below said piston, thereby returning said piston, whereupon the air is exhausted from said cylinder through said exhaust chamber.

7. A jack-hammer according to claim 6 wherein said inside part, said outside part, said tube, and said casing are demountably secured in position.

8. A jack-hammer according to claim 7 wherein said inside part, said outside part, said tube, and said casing all have disposed therethrough an aperture with a removable pin positioned therethrough.

9. A jack-hammer according to claim 1 wherein said handle portion further comprises a lever jointed on one end, and wherein said means for controlling the supply of compressed air further comprises a cavity in said handle portion, a rod sliding in said cavity and a swiveling block sealing the supply of compressed air to said jack-hammer, such that movement of said handle portion jointed on one end slides said rod so as to unseal said swiveling block thereby allowing the supply of compressed air to flow to the jack-hammer.

10. A jack-hammer according to claim 6 wherein said swiveling block is conical in shape, made of resilient material, and is positioned so as to block said air inlet means when said swivel block is not moved by said rod sliding in said cavity by depression of said handle and the supply of compressed air is allowed to flow into said air inlet means when said handle is depressed, thereby sliding said rod in said cavity and moving said swiveling block from blocking said air inlet means.

11. A jack-hammer according to claim 6 wherein said swiveling block has a peripheral soft flange for sealing the supply of compressed air when the jack-hammer is not operating.

12. A jack-hammer according to claim 6 wherein said swiveling block is of truncated conical shape and is aligned with the axis of the supply of compressed air to the jack-hammer such that the larger base of the truncated conical shaped swiveling block seals the supply of compressed air to the jack-hammer.

13. A jack-hammer according to claim 6 wherein said casting is in molded pieces which can be assembled and clipped together to form chambers sealed between said casting and said tube.

14. A compressed air operated jack-hammer comprising:

a tube having an upper cylinder portion and a lower portion;

an air driven piston slidably disposed within said upper cylinder portion to transmit power to a tool;

a sleeve member fitted within said lower portion, said sleeve having a bore for receiving a tool;

a casting secured about said tube, said casting creating air passage means positioned between said cylinder portion and said casting;

a noise insulating, resilient casing enclosing said tube and said casting, said casing having a solid handle portion, said handle portion having a passage, said passage providing unobstructed access therethrough in a direction transverse to the plane of said solid handle portion; said casing adjacent the handle portion further having an opening which directly communicates both with said passage in the handle and said air distributing means; said handle portion further having means for controlling the supply of compressed air to the jack-hammer, said noise insulating, resilient casing further being of one piece construction said passage of the handle communicating with said upper cylinder portion of said tube such that said distributing means is disposed in said tube so as to be removable through said passage in said solid handle portion; and means for distributing compressed air supplied to the jack-hammer, said distributing means being mounted in said tube, said distributing means cooperating with said means for controlling the supply of compressed air and with said air passage means between said cylinder portion and said casting, so as to provide compressed air to said cylinder, thereby causing said piston to reciprocate and drive a tool disposed within the jack-hammer.

15. In a compressed air operated jack-hammer of the type wherein a tube having an upper cylinder portion and a lower portion, an air driven piston slidably disposed within said upper cylinder portion to transmit power to a tool, a sleeve fitted within said lower portion, said sleeve having a polygonal bore for receiving a tool, and a housing secured about said tube so as to create air passage means positioned between said upper cylinder portion and said housing, the improvement comprising:

a noise insulating, resilient casing enclosing said tube and said housing, said casing having a solid handle portion, said handle portion having a passage, said passage providing unobstructed access therethrough in a direction transverse to the plane of said solid handle portion; said casing adjacent the handle portion further having an opening which directly communicates both with said passage in the handle and said air distributing means; said handle portion further having means for controlling the supply of compressed air to the jack-hammer; and means for distributing compressed air supplied to the jack-hammer, said distributing means being mounted in said tube, said distributing means cooperating with said means for controlling the supply of compressed air and with said air passage means between said cylinder portion and said housing, so as to provide compressed air to said cylinder, thereby causing said piston to reciprocate and drive a tool disposed with the jack-hammer, said distributing means further being releasably mounted in said tube and accessible through said passage of the handle such that said distributing means is removable through said passage.

* * * * *

UNITED STATES PATENT AND TRADEMARK OFFICE

CERTIFICATE OF CORRECTION

PATENT NO. : 4,327,807

DATED : May 4, 1982

INVENTOR(S) : Henri Emonet

It is certified that error appears in the above-identified patent and that said Letters Patent is hereby corrected as shown below:

Figures 1, 2, 3, 7 and 16 should appear as shown on the attached sheets.

Signed and Sealed this

*Twenty-seventh* Day of *September 1983*

[SEAL]

*Attest:*

GERALD J. MOSSINGHOFF

*Attesting Officer* *Commissioner of Patents and Trademarks*

Patent No. 4,327,807

Fig-2
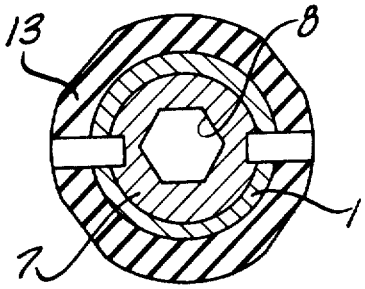
Fig-3
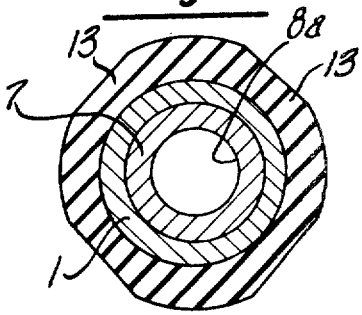
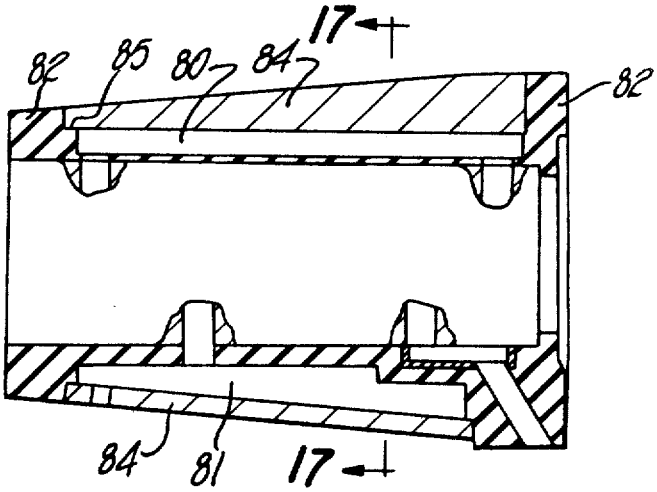
Fig-16

Patent No. 4,327,807